US005247866A

United States Patent [19]

O'Malley

[11] Patent Number: 5,247,866

[45] Date of Patent: Sep. 28, 1993

[54] OPTICALLY SET FUZE SYSTEM

[75] Inventor: Kobi O'Malley, Mountain Lakes, N.J.

[73] Assignee: The United States of America as represented by the Secretary of the Army, Washington, D.C.

[21] Appl. No.: 945,058

[22] Filed: Sep. 16, 1992

[51] Int. Cl.[5] ..... F42C 17/04

[52] U.S. Cl. ..... 89/6; 102/201; 102/266

[58] Field of Search ..... 89/6, 6.5; 102/201, 102/206, 266

[56] References Cited

U.S. PATENT DOCUMENTS 4,318,342 3/1982 Chandler ..... 89/6.5

*Primary Examiner*—Stephen C. Bentley

*Attorney, Agent, or Firm*—Anthony T. Lane; Edward Goldberg; Michael C. Sachs

[57] ABSTRACT

An optically set fuze system for a projectile for a cannon, or the like. The optically set fuze system includes a projectile, a laser beam processing interior circuit and an exterior laser means, which transmits to the laser beam processing interior circuit a composite laser beam for supplying power and for setting timing in the fuze system.

7 Claims, 2 Drawing Sheets

OPTICALLY SET FUZE SYSTEM

GOVERNMENTAL INTEREST

The invention described herein may be manufactured, used, and licensed by or for the Government for governmental purposes without the payment to me of any royalty thereon.

FIELD OF THE INVENTION

The invention relates to an optically set fuze system, and in particular the invention relates to an optically set fuze system, which is used in a cannon medium caliber projectile, which has an interior circuit, and which has an exterior laser means that sets a power charge and timing program of the interior circuit.

BACKGROUND OF THE INVENTION

The prior art projectile fuze system has an interior circuit and has an exterior air core transformer coil for setting a power supply and a timing program of the interior circuit.

One problem with the prior art fuze system is that the exterior air core transformer coil requires a relatively heavy interior air core transformer coil which adds a relatively large mass to the projectile. A second problem is that a relatively large gap between the exterior transformer coil and the interior transformer coil causes a relatively large transmission loss.

SUMMARY OF THE INVENTION

According to the present invention, an optically set fuze system is provided. This system comprises a projectile which has an interior fuze assembly having a first laser beam processing subassembly and a second power supply subassembly and a third timing subassembly with a detonator, and comprises a laser means which provides power and timing laser beams to the projectile first laser beam processing subassembly and which is disposed exterior of the projectile.

By using the interior fuze assembly having a first laser beam processing subassembly and the exterior laser means, the problems of large added mass and transmission loss in the projectile are avoided.

One object of the invention is to provide a projectile fuze system, wherein its mass is minimized and its transmission loss is minimized.

A second object of the invention is to provide a projectile fuze system, wherein jamming by interference signals from electronic jammers is avoided.

The foregoing and other objects, features, and advantages will be apparent from the following description of the preferred embodiment of the invention as illustrated in the accompanying drawings.

DESCRIPTION OF THE PREFERRED EMBODIMENT

Figure 1:
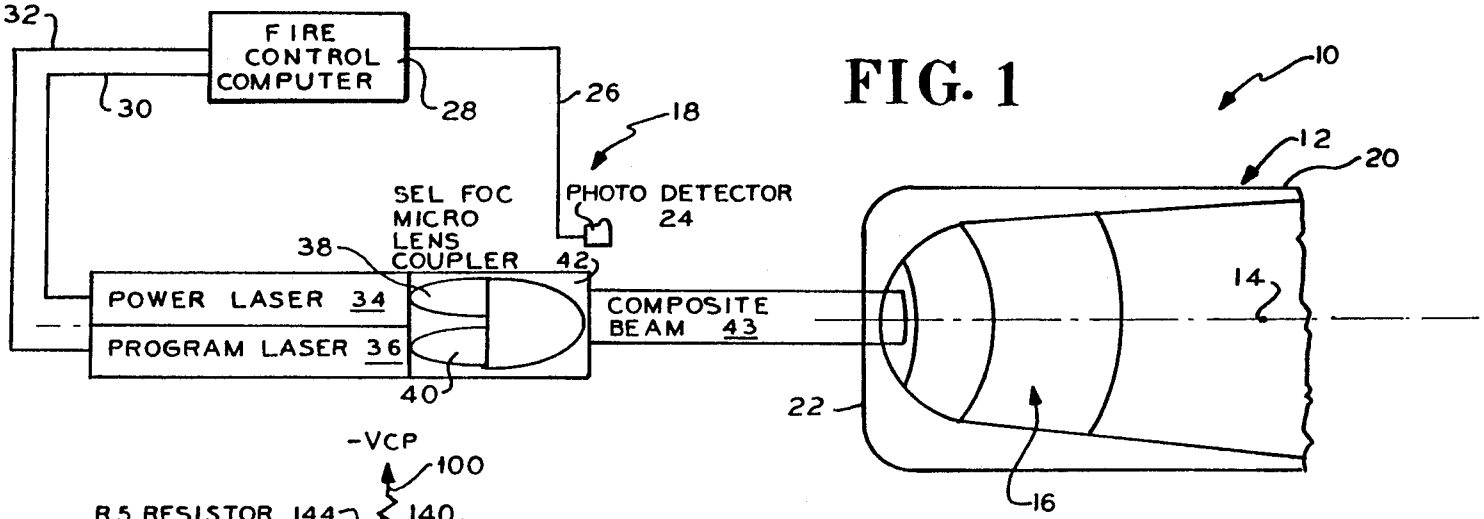
FIG. 1 is a schematic section view of an optically set fuze system according to the present invention.

As shown in FIG. 1, an optically set fuze system or an ammunition system or a system 10 is provided. System 10 has a round of ammunition or a projectile 12, such as one of medium caliber for a cannon. Projectile 12, which has an axis or centerline 14, has an interior optically set fuze assembly or fuze 16. Projectile 12 also has an exterior laser assembly or setter 18, which powers and sets the timing of fuze 16 before flight.

Projectile 12 has an outer casing 20, which is disposed about axis 14, and has a front window or transparent environmental cover or clear end cap 22.

As shown in FIG. 1, exterior laser assembly 18 has a photodetector 24, which has an output conductor 26. Exterior laser assembly 18 also has a fire control computer 28, which is connected to conductor 26, and which has a first output conductor 30 and a second output conductor 32. Exterior laser assembly 18 also has a power laser 34, which connects to first conductor 30, and has a timing or program laser 36, which connects to second conductor 32. Power laser 34 forms a first wavelength power beam 38. Timing laser 36 forms a second wavelength timing beam 40.

As shown in FIG. 1, exterior laser assembly 18 also has a microlens coupler 42, such as a selfoc microlens coupler that is sold under the trademark "SELFOC", which receives first and second beams 38, 40, and which outputs a composite beam 43. Composite beam 43 is disposed along axis 14, and is equal to the sum of the respective wavelengths of the first and second beams 38, 40.

Interior fuze assembly 16 has a first laser beam processing subassembly 44, and has a second power subassembly 45, and has a third timing subassembly 46.

Figure 2:
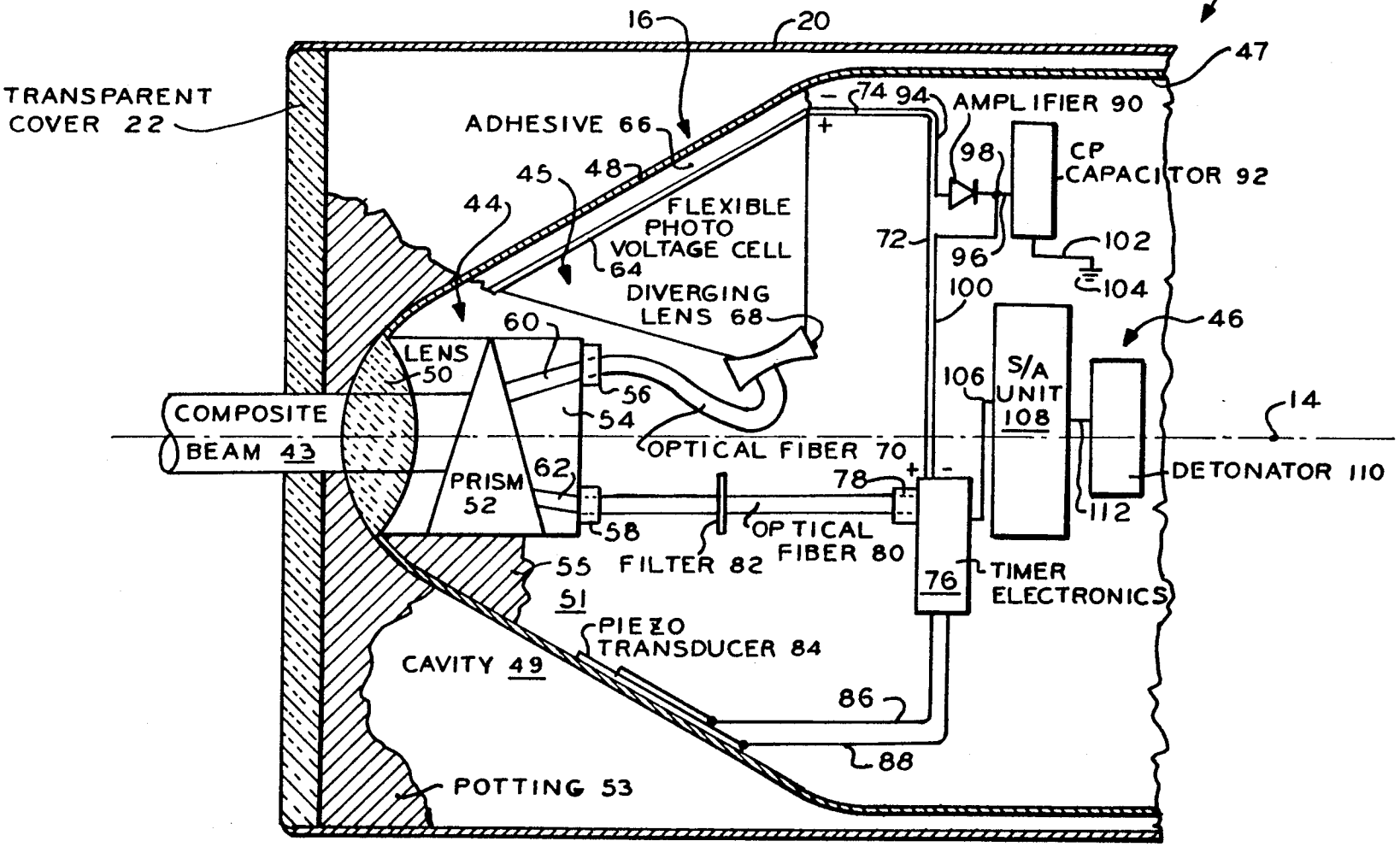
FIG. 2 is an enlarged section view of a portion of the optically set fuze system of FIG. 1.

As shown in FIG. 2, projectile 12 has an annular metal support wall 47. Wall 47 has conical front wall portion 48. Wall 20 and walls 47, 48 form an outer cavity 49 and form an inner chamber 51. Cavity 49 and chamber 51 contain respective potting materials 53, 55, such as plastic potting materials.

First laser beam processing subassembly 44 has a front transparent focusing lens 50, which is mounted on wall 48. Subassembly 44 also has a prism unit or beam splitter or defraction grating or prism 52, which is mounted behind lens 50. Prism 52 has a rear wall 54, which supports a first microlens or selfoc microlens 56, and which supports a second microlens or selfoc microlens 58. Prism 52 separates or reforms the composite beam 43 into a first wavelength power beam 60 and a second wavelength timing beam 62. First and second beams 60, 62 enter respective first and second microlens units 56, 58 for further transmission thereof.

As shown in FIG. 2, second power subassembly 45 has a flexible silicon wafer or photovoltaic cell 64, which is attached to conical wall 48 by an adhesive 66, such as a silicone rubber adhesive. Subassembly 45 also has a diverging lens 68. Subassembly 45 also has a first optical fiber to which is connected to first microlens 56 at an input end thereof, and which is connected to diverging lens 68 at an output end thereof. Cell 64 also has a first positive power output lead 72 and has a second negative power output lead 74.

Third timing subassembly 46 has a timer electronics unit or timer 76. Timer 76 has a terminal portion 78. Subassembly 46 also has a second optical fiber 80, which is connected to microlens 58 at its input end. Second optical fiber 80 has a filter 82, which is disposed near the midlength point thereof. Second optical fiber 80 is connected to terminal 78 at its output end.

As shown in FIG. 2, third timing subassembly 46 also has a piezo transducer 84, which has a first lead 86 and a second lead 88, that connects to timer 76. Transducer 84 is mounted on conical wall 48 and is disposed about diametrically opposite to cell 64.

Third timing subassembly 46 also has an amplifier 90 and has a Cp capacitor 92. Amplifier 90 has an inlet terminal 94 which is connected to lead 74. Amplifier 90 has an outlet connector 96, which is connected to Cp capacitor 92. Connector 96 has a junction 98. Timer 76 has a negative power lead 100, which is connected to junction 98. Capacitor 92 has an output connector 102, which is connected to ground 104. Timer 76 also has an output connector 106.

Third timing subassembly 46 also has an S/A unit 108, and has a detonator 110. (S/A is an abbreviation for Safe and Arm.) S/A unit 108 has an output connector 112, which is connected to detonator 110. S/A unit 108 is also connected to connector 106 from timer 76.

Figure 3:
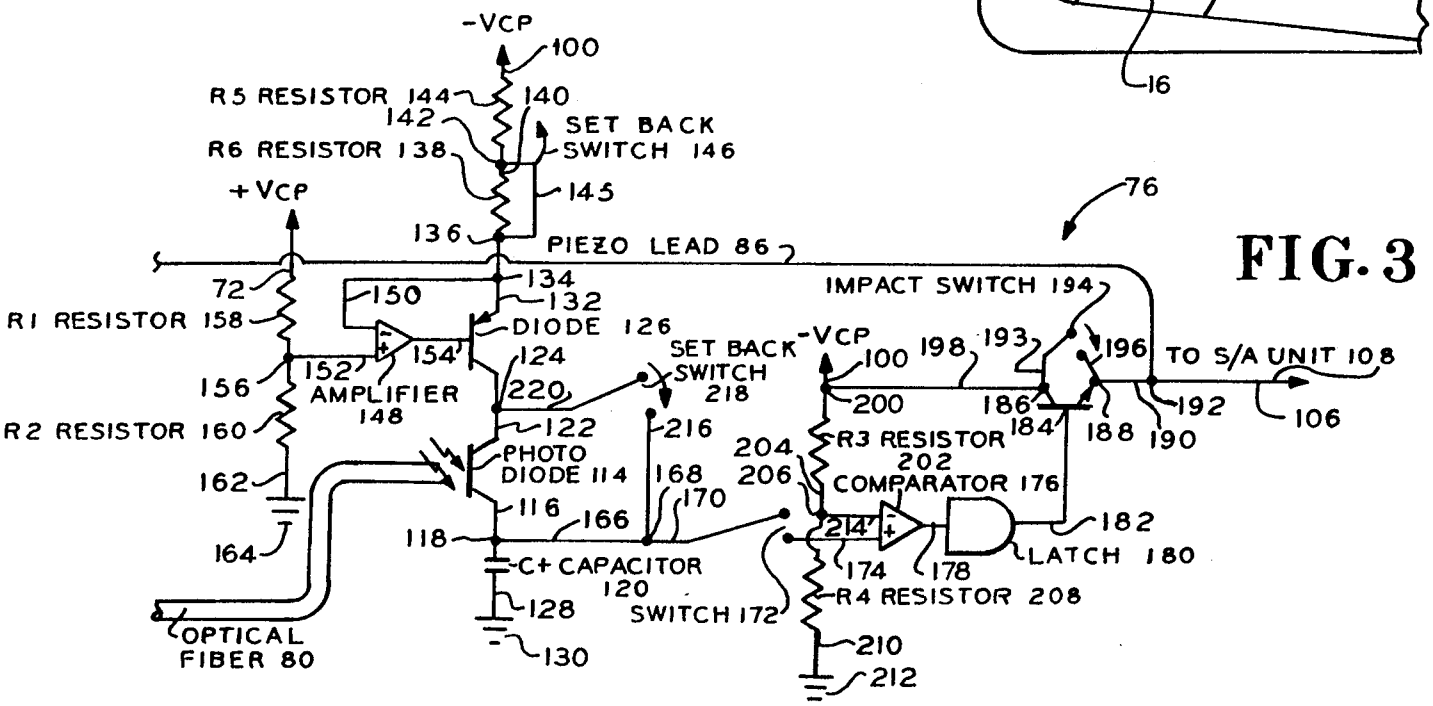
FIG. 3 is a circuit diagram of the timer electronics part of the portion of the optically set fuze system of FIG. 2.

As shown in FIG. 3, which is a timer circuit diagram, timer 76 has a photodiode 114, which is connected to and receives signals from optical fiber 80. Photodiode 114 has a first connector 116, which is connected through a junction 118 to a Ct capacitor 120. Photodiode 114 has a second connector 122, which is connected through a junction 124 to a plain diode 126. Ct capacitor 120 has a connector 128, which is connected to a ground 130. Diode 126 has a connector 132, which is connected through a first junction 134 and through a second junction 136 to an R6 resistor 138. R6 resistor 138 has a connector 140, which is connected through a junction 142 to an R5 resistor 144. R5 resistor 144 is connected to lead 100 for supply of a −Ycp voltage from Cp capacitor 92.

A parallel connector 145 extends from junction 136 through a setback switch 146 to junction 142. Diode 126 also is connected to an amplifier 148. Amplifier 148 has a negative input connector 150, which is connected to junction 134. Amplifier 148 also has a positive input connector 152. Amplifier 148 also has an output connector 154, which is connected to diode 126. Connector 152 is connected through a junction 156 to an R1 resistor 158. R1 resistor 158 is connected to lead 72 for supply of a +vcp voltage from cell 64. Connector 152 also is connected through junction 156 to an R2 resistor 160. R2 resistor 160 has a connector 162, which is connected to a ground 164.

Photodiode 114 is connected through connector 116 to junction 118. A connector 166 is connected to junction 118 at one end thereof, and is connected to a junction 168 at an opposite end thereof. A connector 170 is connected to junction 168 at one end thereof, and is connected to a switch 172 at an opposite end thereof. Switch 172 has a connector 174 which is connected to a comparator 176 at a positive input terminal thereof. Comparator 176 has an output connector 178, which is connected to a latch 180. Latch 180 has an output connector 182, which is connected to a transistor 184. Transistor 184 has a first terminal 186 and has a second terminal 188. Terminal 188 is connected to a connector 190, which is connected through a junction 192 to line 106 to S/A unit 108. Junction 192 is connected to piezo lead 86.

Terminal 186 is connected to a connector 193, which is connected to an impact switch 194. Impact switch 194 has a connector 196, which is connected to terminal 188. Terminal 186 is also connected to a connector 198, which is connected through a junction 200 to line 100 for supply thereto of −Vcp voltage. Junction 200 is also connected to an R3 resistor 202, which has a connector 204. Connector 204 is connected through a junction 206 to an R4 resistor 208, which has a connector 210 that is connected to a ground 212. Comparator 176 also has a negative input connector 214, which is connected to junction 206.

A connector 216 is connected at one end thereof to terminal 168, and is connected at an opposite end thereof to a setback switch 218. Switch 218 has a connector 220, which is connected to junction 124.

In operation, fuze 16 is powered up and programmed with two laser beams 38, 40 of different wavelengths. These lasers are located on a gun feeder (not shown=NS) and program high explosive round 12 prior to feeding into a gun (NS). Photodetector 24 senses the presence of round 12. Composite beam 43 is created by a microlens coupler 42. Beam 43 is directed into clear end cap 22 of ammunition round 12. Composite beam 43 is captured by lens 50 located on fuze 16 which focuses composite beam 43 onto a diffraction grating or prism 52 which separates two beams 60, 62 into respective optical fiber cables 70, 80. Power beam 60 is guided to diverging lens 68 which distributes the laser energy over flexible silicon photovoltaic cell 64. Photovoltaic cell 64 is mounted on a thin layer of silicon or adhesive rubber 66 which bonds it to the fuze wall portion 48. This is done to maximize the surface area of cell 64 and to provide a cushion against rough handling of round 12. The output of photovoltaic cell 64 is guided by wire 74 to Cp capacitor 92. The energy stored on Cp capacitor 92 is used to power timer electronics 76 and to activate detonator 110.

This power laser 34 will continue to deliver power to the fuze 16 until the round 12 is loaded into the chamber (NS). Once the round 12 is loaded, the energy stored in fuze 16 will remain until it is used by the timer electronics 76 after launch. Separate laser beam 62 is used to deliver the time information to the Ct capacitor 120 (FIG. 3).

Timing beam 62 is guided by optical fiber 80 to photodiode 114. The photodiode 114 gates the constant current I to charge the Ct capacitor 120. The fire control computer 28 gates the timing laser 36 to a selective time. The timer 76 is completely independent of the voltage on the Cp capacitor 92. This is significant because as the Cp capacitor 92 is discharged, its voltage will decrease, but this has no effect on the fuze performance. Timing accuracy will therefore not vary from lot to lot. The set back switch 218 continues to charge Ct capacitor 120 to the threshold voltage which will detonate the fuze 16 provided the independent S/A unit 108 is activated by proper launch. If the round 12 should impact before the time of flight has elapsed, a point detonating back switch or piezo electric crystal 194 will detonate the fuze 16. The entire fuze cavity 49 and chamber 51 is filled with potting 53, 55 to keep all wiring and optical fibers 70, 80 intact.

The advantages of fuze system 10 are indicated hereafter.

A) The problem of large added mass in the prior art projectile due to an interior transformer coil is avoided.

B) The problem of transmission loss in the prior art fuze system due to transmission between an exterior transformer coil and an interior transformer coil is avoided.

C) The fuze system 10 according to the invention minimizes mass added to the projectile 12.

D) The fuze system 10 according to the invention minimizes transmission loss between the exterior laser assembly 18 and the interior fuze assembly 16.

E) The fuze system 10 according to the invention avoids jamming by interference signals from electronic jammers.

While the invention has been described in its preferred embodiment, it is to be understood that the words which have been used are words of description rather than limitation and that changes may be made within the purview of the appended claims without departing from the true scope and spirit of the invention in its broader aspects.

What is claimed is:

1. An optically set fuze system consisting:

a projectile having an axis;

an interior fuze assembly which is disposed inside the projectile;

said interior fuze assembly having a first laser beam processing subassembly and having a second power subassembly and having a third timing subassembly with a detonator; and an exterior laser means which is disposed outside the projectile;

said exterior laser means having a fire control computer and having a power laser connected to the fire control computer and having a timing laser connected to the fire control computer and having beam coupler means for transmitting a composite laser beam to the interior fuze assembly first laser beam processing subassembly.

2. The system of claim 1, wherein the composite laser beam transmits a first wavelength beam from the power laser and a second wavelength beam from the timing laser.

3. The system of claim 2, wherein the exterior laser means includes a microlens coupler which is mounted adjacent to respective output ends of the power laser and the timing laser for receiving the power laser first wavelength beam and the timing laser second wavelength beam and for outputting the composite beam.

4. The system of claim 3, wherein the first laser beam processing subassembly includes a front focusing lens coaxially mounted on a front portion of the projectile for receiving the composite beam, and includes a beam splitter for forming a first wavelength power beam and a second wavelength timing beam, and includes a first power microlens which receives the first wavelength power beam and a second timing microlens which receives the second wavelength timing beam.

5. The system of claim 4, wherein the second power subassembly includes a photovoltaic cell supported by a projectile wall and includes a diverging lens facing the photovoltaic cell and includes a first optical fiber connected at an output end to the diverging lens and connected at an input end to the first power microlens and wherein the photovoltaic cell has a first positive power lead and has a second negative power lead.

6. The system of claim 5, wherein the third timing subassembly includes a timer unit and includes a second optical fiber connected at an output end to the timer unit and connected at an input end to the second timing microlens, and includes a piezo transducer supported by a projectile wall and having first and second leads which connect to the timer unit, and includes an amplifier having an inlet terminal connected to the photovoltaic cell second negative power lead and having an outlet connector connected to a Cp capacitor, said Cp capacitor having an outlet connector connected to a ground, said amplifier outlet connector having a junction and said timer unit having a negative power lead connected to the junction, and wherein the timer unit has an outlet connector connected to an S/A unit, and wherein the S/A unit has an outlet connector connected to a detonator.

7. The system of claim 6, wherein the timer unit includes:

a photodiode which receives signals from the second optical fiber;

a Ct capacitor which is connected to the photodiode;

a plain diode which is connected to the photodiode;

an R6 resistor which is connected to the plain diode;

an R5 resistor which is connected to the R6 resistor and which is supplied by a connector with −Ycp voltage from the Cp capacitor;

an amplifier which is connected to the plain diode and which is connected to an R1 resistor that is supplied with +vcp voltage and which is connected to an R2 resistor that is connected to a ground;

a switch which is connected at an inlet and to the photodiode and to the Ct capacitor;

a comparator which is connected at a positive inlet to the switch;

a latch which is connected at an inlet to the comparator;

a transistor which is connected at an inlet to the latch; and the transistor having an outlet terminal which is connected to one of the piezo transducer leads and which is also connected to an inlet of the S/A unit.

* * * * *